US009271557B2

(12) United States Patent
Corbellini et al.

(10) Patent No.: US 9,271,557 B2
(45) Date of Patent: Mar. 1, 2016

(54) COSMETIC APPLICATOR SYSTEM WITH ONE FUNCTIONAL AND ONE NON-FUNCTIONAL APPLICATOR

(71) Applicant: ELC Management LLC, Melville, NY (US)

(72) Inventors: Francis Corbellini, Thiais (FR); Herve F. Bouix, New York, NY (US)

(73) Assignee: ELC MANAGEMENT, LLC, Melville, NY (US)

( * ) Notice: Subject to any disclaimer, the term of this patent is extended or adjusted under 35 U.S.C. 154(b) by 33 days.

(21) Appl. No.: 14/207,784

(22) Filed: Mar. 13, 2014

(65) Prior Publication Data

US 2015/0257512 A1 Sep. 17, 2015

(51) Int. Cl.

| | |
|---|---|
| ***A47L 23/04*** | (2006.01) |
| ***A45D 40/26*** | (2006.01) |
| ***A45D 34/06*** | (2006.01) |
| ***A45D 40/24*** | (2006.01) |
| *A45D 40/00* | (2006.01) |

(52) U.S. Cl.

CPC ..... *A45D 40/265* (2013.01); *A45D 34/06* (2013.01); *A45D 40/24* (2013.01); *A45D 2040/0012* (2013.01); *A45D 2200/052* (2013.01)

(58) Field of Classification Search

CPC ..... A45D 40/24; A45D 40/18; A45D 34/06
USPC ..... 401/37–39, 17
See application file for complete search history.

(56) References Cited

U.S. PATENT DOCUMENTS

| | | | | |
|---|---|---|---|---|
| 2,065,800 | A * | 12/1936 | Freeman | 401/50 |
| 2,458,063 | A | 1/1949 | Dulberg | |
| 2,571,620 | A | 10/1951 | Sala | |
| 2,691,184 | A | 10/1954 | Miller et al. | |
| 2,829,655 | A | 4/1958 | Bau | |
| 2,902,041 | A | 9/1959 | Bau | |
| 3,071,143 | A * | 1/1963 | Bau | 401/128 |
| 3,073,320 | A | 1/1963 | Seaver | |
| 3,592,202 | A | 7/1971 | Jones | |
| 3,688,450 | A | 9/1972 | Brockman | |
| 3,690,777 | A | 9/1972 | Costa | |
| D286,163 | S | 10/1986 | Shintani | |
| D287,168 | S | 12/1986 | Kingsford et al. | |
| D295,878 | S | 5/1988 | Lovell | |
| 4,886,080 | A | 12/1989 | Cole | |
| 5,056,179 | A | 10/1991 | Capponi | |
| 5,509,742 | A | 4/1996 | Balzarini | |
| 5,655,554 | A | 8/1997 | Goldberg | |
| 5,970,990 | A | 10/1999 | Dunton et al. | |

(Continued)

FOREIGN PATENT DOCUMENTS

| | | |
|---|---|---|
| CA | 1158602 | 12/1983 |
| DE | 3923731 A1 | 1/1991 |

*Primary Examiner* — Jennifer C Chiang
(74) *Attorney, Agent, or Firm* — Peter Giancana

(57) ABSTRACT

A cosmetic applicator system that comprises first and second applicator heads that are identical or substantially identical and coaxial with each other. The first applicator head extends from a closure that is able to engage a product reservoir to seal and unseal the reservoir. The second applicator head is non-functional, and extends from the closure in a direction that is opposite to the first applicator head. When the closure is engaged on the reservoir, the first applicator head is immersed in the reservoir, while the second applicator head remains visible. A transparent protective cap may be provided for the second applicator head.

4 Claims, 10 Drawing Sheets

(56) References Cited

U.S. PATENT DOCUMENTS 6,612,764 B2 9/2003 Dumer et al.
6,682,242 B1 1/2004 Montoli
7,374,356 B2 * 5/2008 Oike ..... 401/23
2002/0018688 A1 2/2002 Dumler et al.

* cited by examiner

COSMETIC APPLICATOR SYSTEM WITH ONE FUNCTIONAL AND ONE NON-FUNCTIONAL APPLICATOR

FIELD OF THE INVENTION

The invention pertains to cosmetic applicator systems. Specifically, the invention pertains to immersion-type cosmetic applicator systems.

DESCRIPTION OF THE PRIOR ART

By a "wand-type" applicator we mean an extended rod or stem having a proximal end with a handle and a distal free end that is adapted to aid in the delivery of product to a product application surface. The extended rod allows the free end to reach to the bottom of a product reservoir. The extended rod also facilitates application of the product and grooming, by providing clearance between the applicator head and the handle of the applicator. This clearance is especially necessary for mascara application to the eyelashes. This definition might include a cotton swab, but not a cotton ball, because a cotton ball does not have an extended rod or stem with a proximal and a distal end.

By an "immersion-type" applicator we mean a wand-type applicator having a distal end that is adapted to be immersed in a reservoir of product, to remove product from the reservoir. Conventional mascara applicators fit this description. Examples of applicators that do not fit this description include those in which product is made to flow from an integrated reservoir, through an applicator head and onto the applicator surface.

Immersion-type cosmetic applicator systems that have two wand-type applicators are known. For example, there are applicator systems having two product reservoirs, one for each applicator, wherein the reservoirs are joined together, often end to end or side by side. U.S. Pat. No. 4,886,080 and U.S. Pat. No. 2,691,184 describe systems where the applicator heads point toward each other. U.S. Pat. No. 3,690,777, U.S. Pat. No. 6,612,764, U.S. Pat. No. 6,682,242, US200210018688, DE3923731 and CA1,158,602 describe systems in which the applicator heads point away from each other. Systems with applicator heads pointing in the same direction are described in U.S. Pat. No. 5,509,742 and US-D287,168.

There are also applicator systems having two wand-type applicators, but only one product reservoir, and only one entry into the reservoir. U.S. Pat. No. 2,829,655, U.S. Pat. No. 5,970,990, U.S. Pat. No. 2,902,041 and U.S. Pat. No. 3,073,320 describe systems wherein one of the wand-type applicators is not intended to be immersed in the product reservoir. Often this applicator is actually a grooming tool, such as a comb or other accessory tool. Both wand-type applicators may be attached to the same closure that seals off the reservoir, and a removable cap is provided for the applicator that does not go into the reservoir.

There are also applicator systems having two wand-type applicators, but neither applicator is ever immersed in a product reservoir. Either product is made to flow from a reservoir, through an applicator head and onto the applicator surface (for example, U.S. Pat. No. 3,592,202, US-D286,163, US-D295,878, and U.S. Pat. No. 3,688,450) or there is no product in the applicator system (i.e. U.S. Pat. No. 5,056,179).

In all of the applicator systems described in the foregoing references, all of the applicator heads are functional. In almost all of them, the applicator heads are different from each other. In US-D295,878, the applicator heads appear to be identical, but apparently dispense different products (i.e. differently colored inks).

Sometimes a cosmetics seller wants to show potential customers the type of applicator that comes with a product. However, the applicator head is not visible when it is immersed in a product reservoir, as it is when the product reservoir is sealed for distribution in a commercial environment. One way around this problem is by sealing the product reservoir with temporary closure or seal, and then packaging the reservoir and the applicator side-by-side, in a transparent outer packaging. The problem here is that a relatively small and sleek design, such as a mascara tube, is replaced by a bulky plastic over shell. The plastic overshell significantly increases the cost of goods. Also, once the applicator head is immersed in the product, the applicator head is again not visible. A woman who owns several mascara products, for example, may not remember which applicator is in each product.

OBJECTS OF THE INVENTION

A main object of the invention is to provide a cosmetic applicator system with two identical or substantially identical applicators, one functional, but not always visible, and one non-functional, but always visible.

Another object of the invention is to provide a cosmetic applicator system that can be distributed and sold in a fully assembled condition, while still allowing a consumer to see the type of applicator head that she is purchasing.

SUMMARY

Like some of the applicator systems of the prior art, the applicator system of the present invention has one reservoir that holds a product, or that is able to hold a product; one wand-type applicator having a distal free end that must be immersed in the product reservoir in order to remove product from the reservoir; and one wand-type applicator that is intended not to be immersed in the product reservoir. Like some of the prior art, both applicators are attached to the same closure, and a cap for the applicator that is not intended to be immersed in the product reservoir is supplied. Unlike the prior art, however, the present applicator system has two identical or substantially identical applicators. In preferred embodiments, a cap is provided for the applicator that is not intended to be immersed in the product reservoir. More preferably, this cap is permanently affixed, thus rendering that applicator non-functional. Preferably, at least a portion of the non-removable cap is transparent, so that the non-functional applicator can be seen by the unaided human eye.

Throughout the figures, repeated reference numbers denote the same feature in assorted embodiments of the invention.

DETAILED DESCRIPTION

Figure 1:
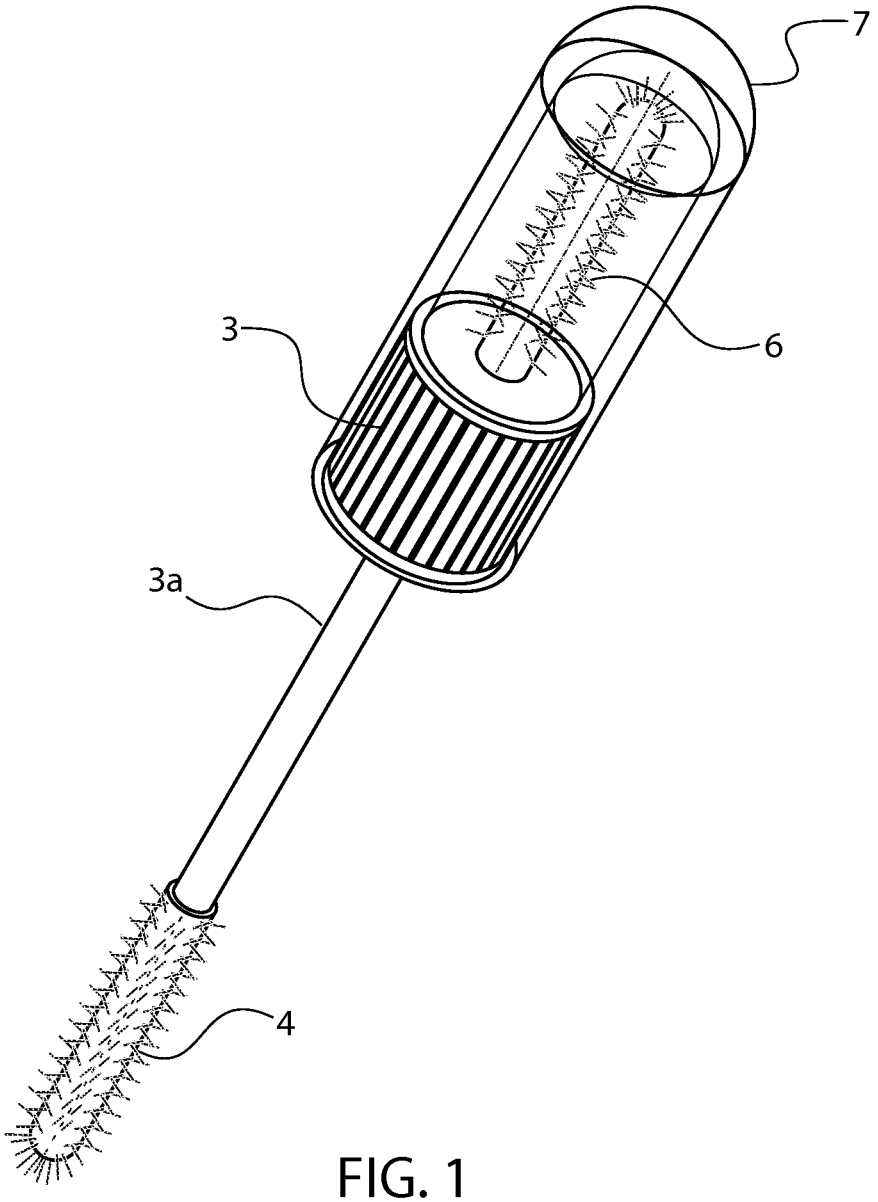
FIG. 1 is a first embodiment of a wand-type, immersion-type applicator according to the present invention.
Figure 2:
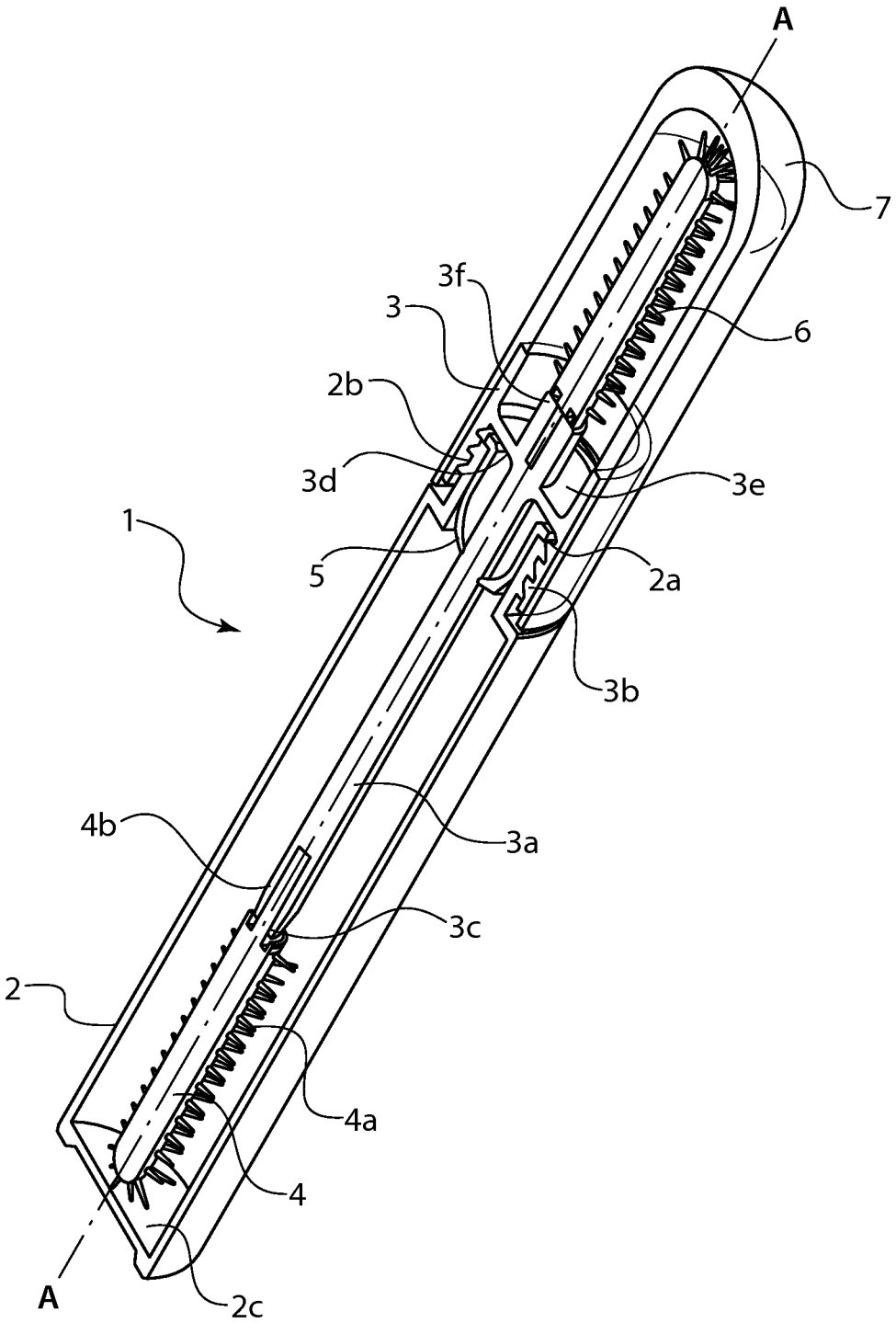
FIG. 2 is a cross sectional view of the applicator of FIG. 1, but shown assembled to a product reservoir.
Figure 8:
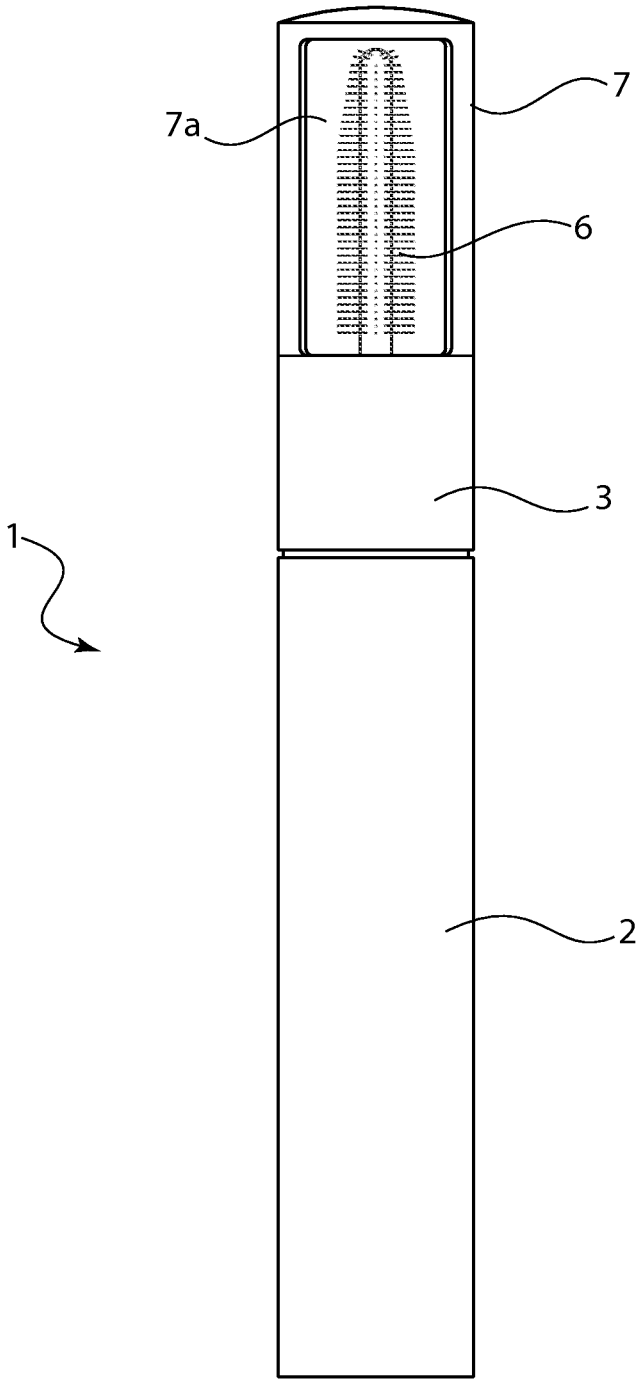
Figure 9:
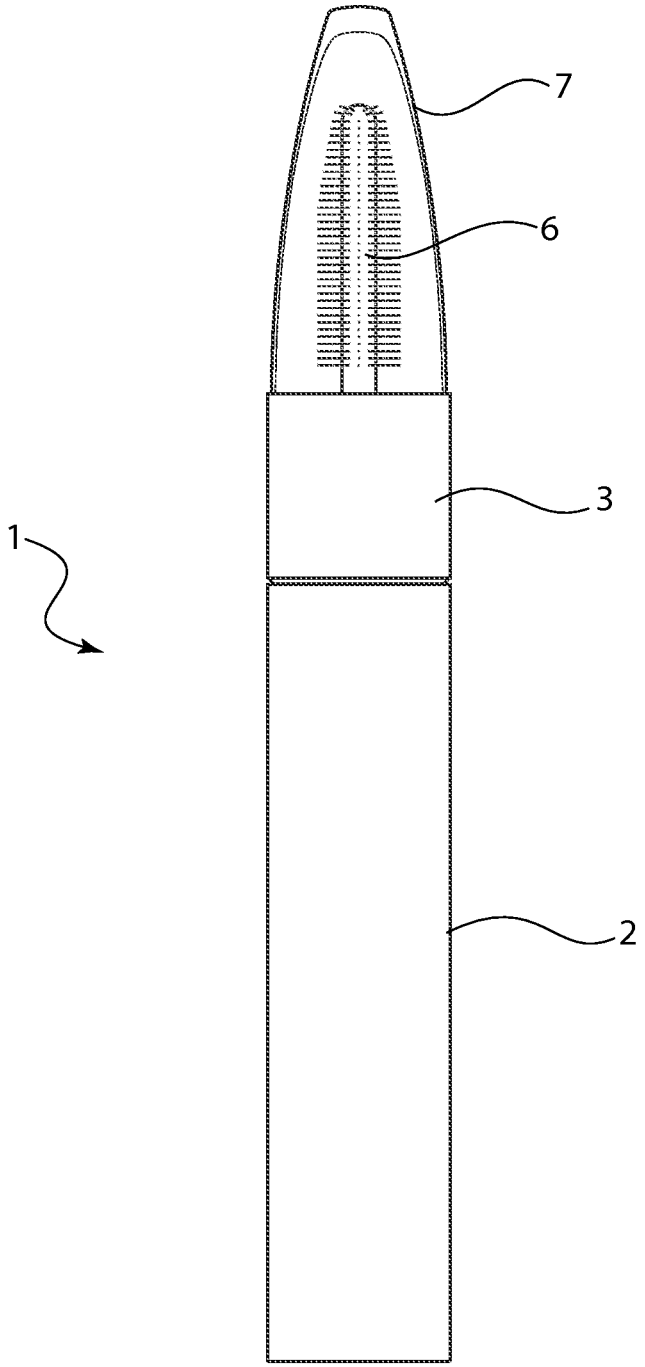
Figure 10:
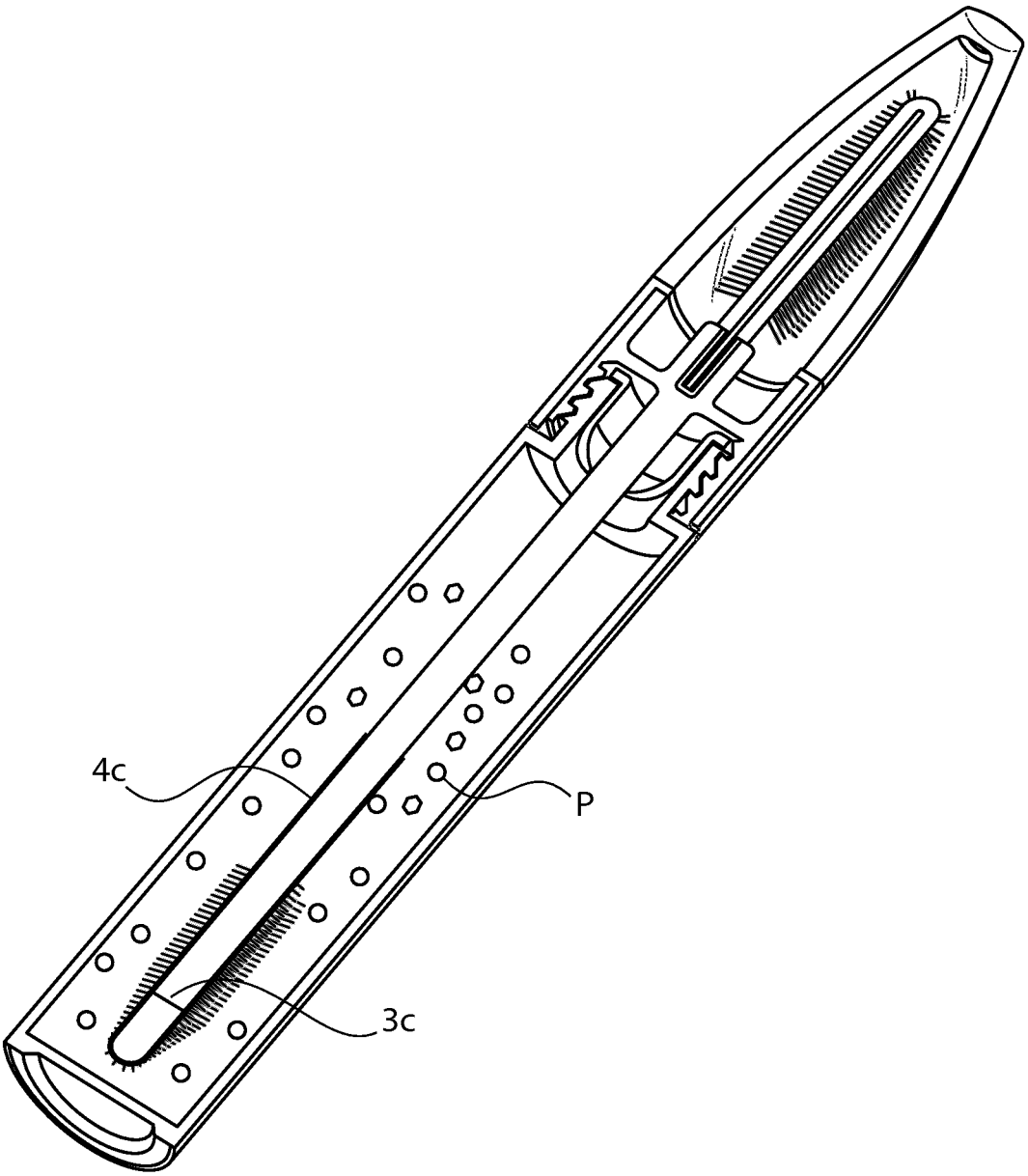
FIG. 10 is a cross sectional view of the applicator system of FIG. 9.

Referring to the embodiment of FIGS. 1 and 2, an applicator system (1) comprises exactly one reservoir (2) that is able to hold a cosmetic product ('P' in FIG. 10). The opened end (2*a*) of the reservoir is adapted to be sealed and unsealed, such as by a closure (3) that comprises threads (3*b*), that are designed to engage to a treaded neck (2*b*) of the reservoir. Depending from an interior surface (3*d*) of the closure is a wand (3*a*), or extended rod, that has a distal free end (3*c*) that extends down into the reservoir when the closure is engaged with the neck of the reservoir. The distal end of the wand supports a first applicator head (4) that is adapted to remove product from the reservoir, and aid in the delivery of product to a product application surface. For example, the first applicator head may be implemented as a mascara brush. In that case, any type of applicator head known to be useful in making up the eyelashes may be suitable for use in the present invention. Several examples of mascara brush heads are shown in FIGS. 1, 3 and 5-9. A portion (4*b*) of the first applicator head (4) may insert into the distal end (3*c*) of the wand (3*a*) (as in FIGS. 2 and 4), or the first applicator head may be implemented as a sleeve (4*c*) that fits over the distal end of the wand (as in FIG. 10). In either case, the length of the wand is such that the applicator head is able to reach to the bottom (2*c*) of the reservoir when the closure (3) is engaged with the neck (2*b*) of the reservoir.

As is usually done in the art, the opened end (2*a*) of the reservoir (2) may be fitted with a wiper element (5) which function is to remove excess product from the bristles (4*a*) of the first applicator head (4).

Protruding from an exterior surface (3*e*) of the closure (3), is a second applicator head (6). Generally, the second applicator head is co-axial with, but pointing away from the first applicator head (4). The second applicator head may be attached to the closure through a short stem (3*f*) that arises from the exterior surface (3*e*) of the closure. Preferably, the short stem is short enough to render the second applicator head non-functional. For example, the short extension of the second applicator head means that even if the second applicator head were inserted into the opened end (2*a*) of the reservoir (2), the second applicator head is unable to reach the product in the reservoir. Also, the relatively short extension of the second applicator head beyond the closure (3) inhibits the second applicator head from being used to groom the eyelashes, because the closure (3) gets in the way. Thus, a critical feature of the invention is that the second applicator head (6) be non-functional as a product applicator. Nevertheless, the second applicator head does have a purpose. When the closure (3) is engaged with the neck (2*b*) of the reservoir, then the first applicator head is not visible, being immersed in the reservoir, but the second applicator head remains visible at all times.

Figure 3:
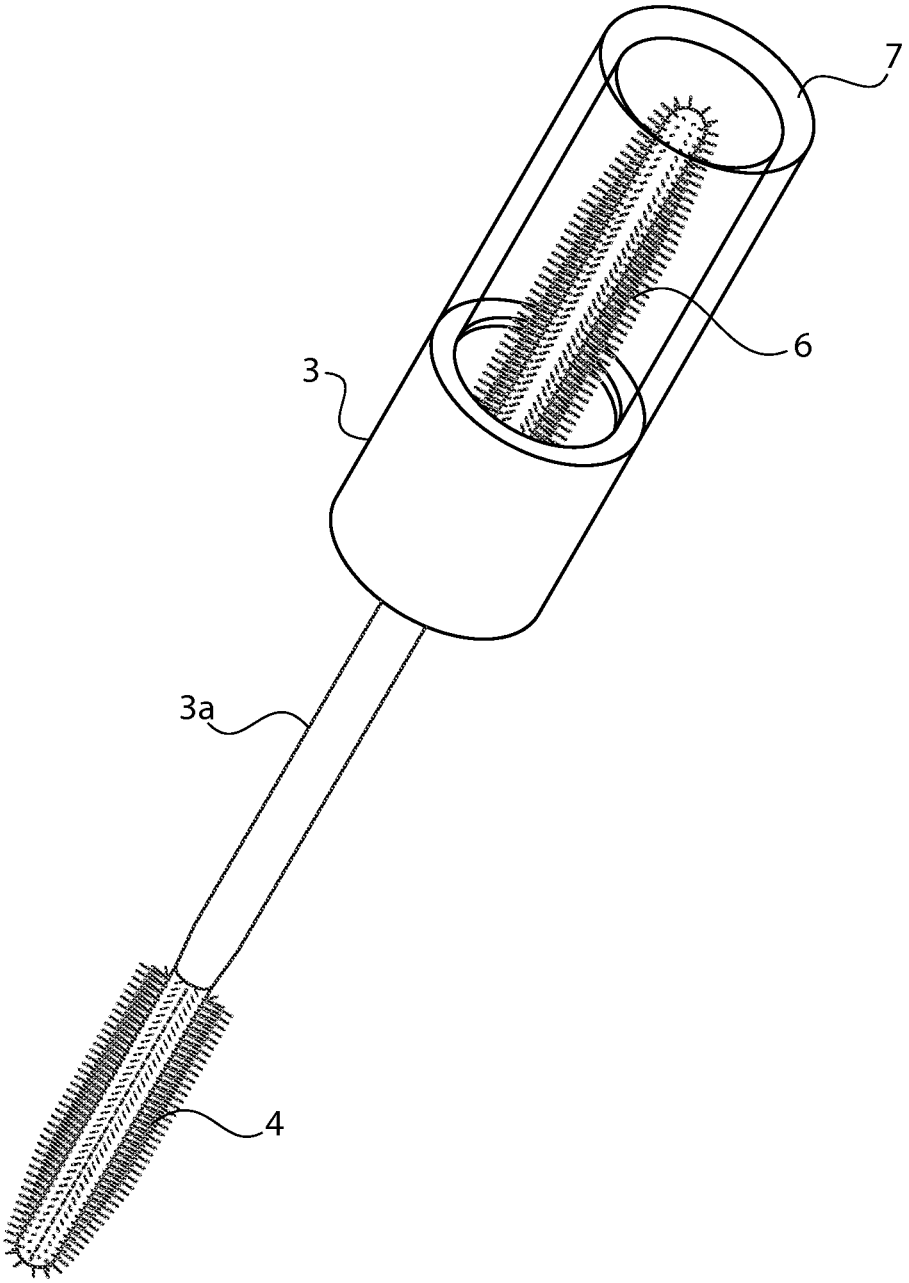
FIG. 3 is a second embodiment of a wand-type, immersion-type applicator according to the present invention.
Figure 4:
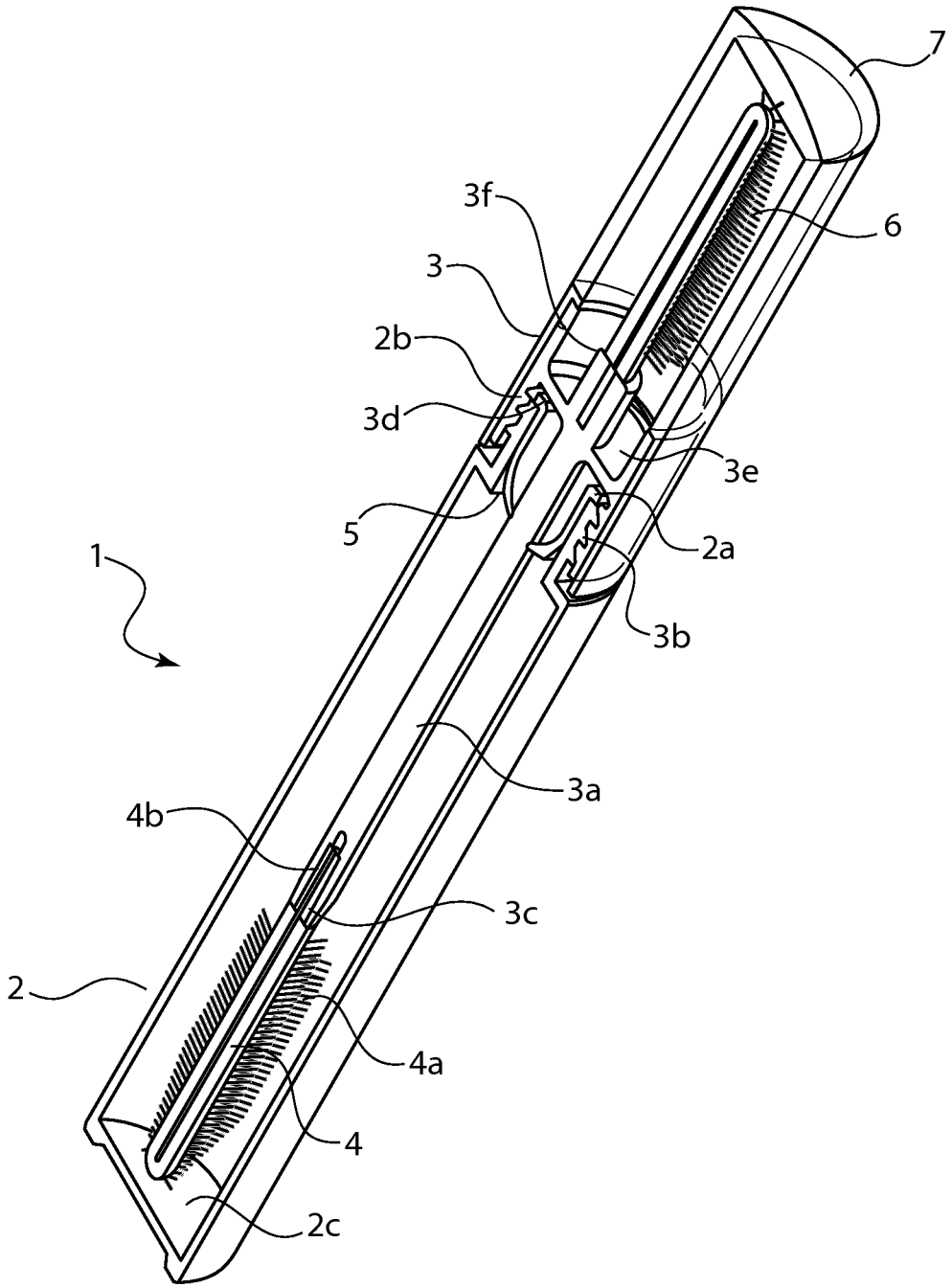
FIG. 4 is a cross sectional view of the applicator of FIG. 3, but shown assembled to a product reservoir.
Figure 5:
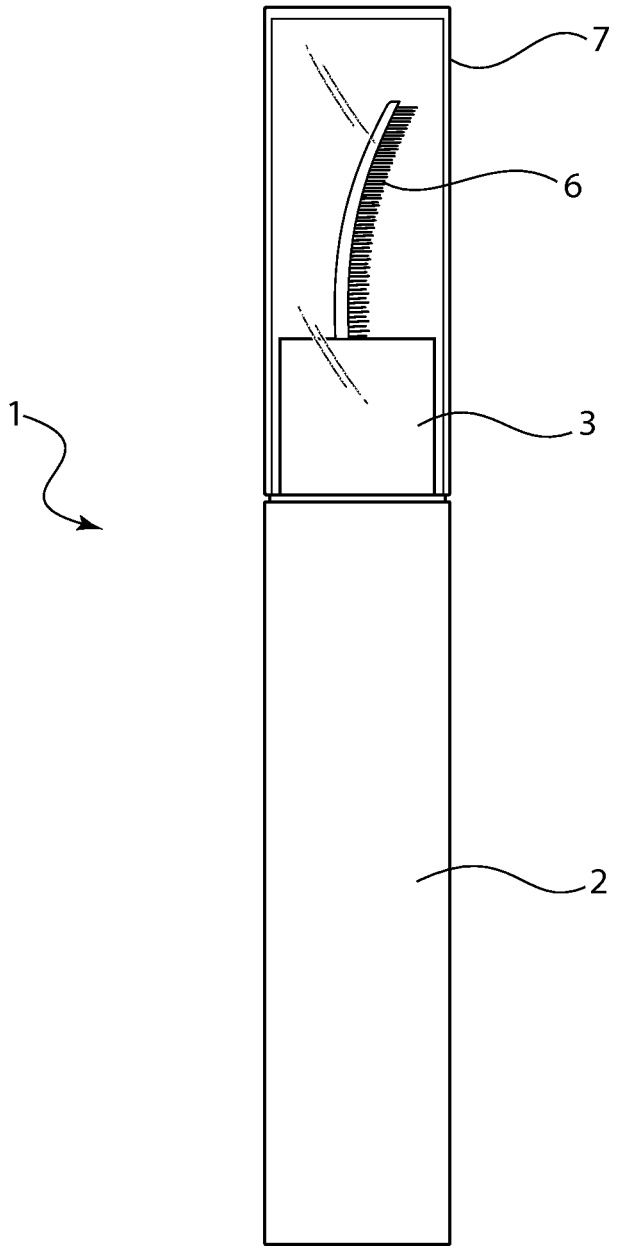
FIGS. 5-9 are various embodiments of applicator systems of the present invention, as they look when fully assembled to a product reservoir.
Figure 6:
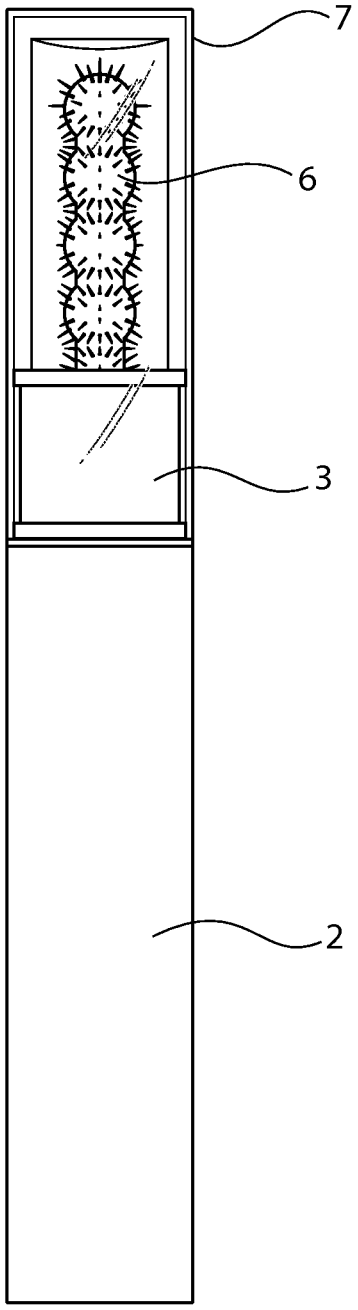
Figure 7:
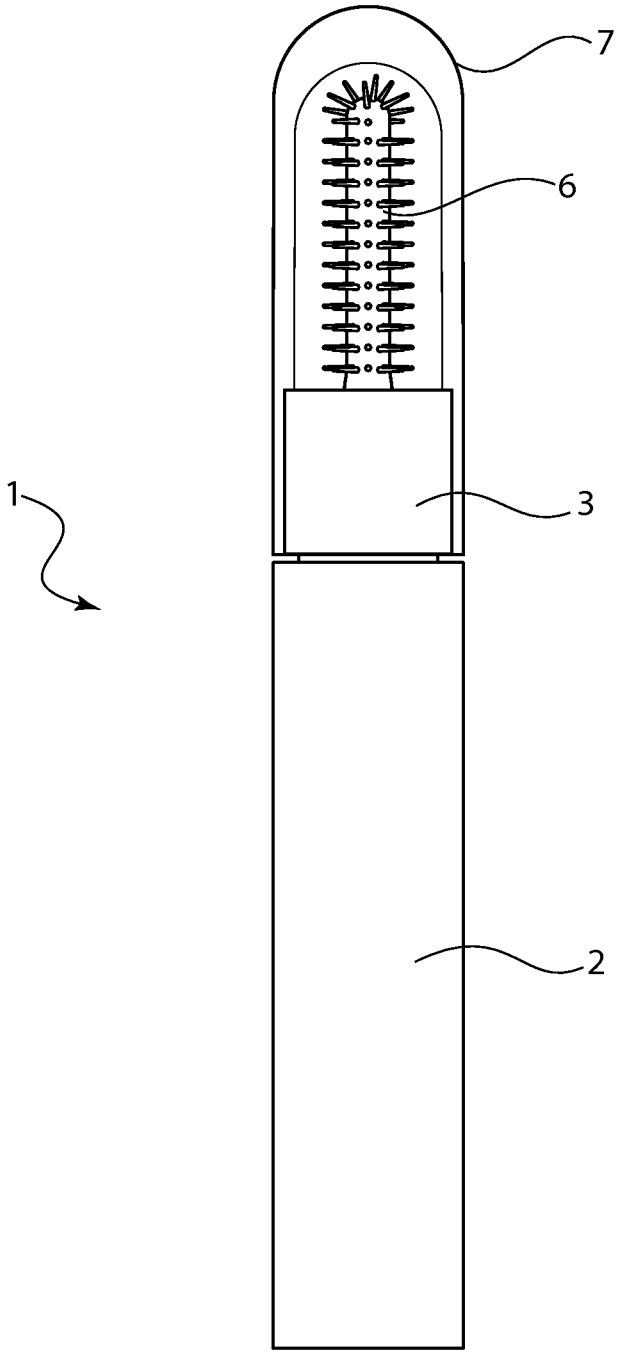

The second applicator head (6) may be protected by a cap that surrounds the second applicator head. Preferably, this is the case. Furthermore, because the second applicator head is non-functional, it may be preferable if the protective cap cannot be removed by ordinary means. For example, a non-removable cap (7) may be provided that rigidly connects to the closure (3) by any suitable, permanent means, such as with adhesive, welding, snap fitments, crimping, etc. In order the for the second applicator head to remain visible, at least a portion of the non-removable cap (7) should be transparent. The transparent portion may be a cut-out (see FIG. 8) or a transparent material (as in FIGS. 1, 3, 5, 6, 7, 9). Preferred transparent materials have a light transmission rate of at least 80%, so that the view of the second applicator head is not obscured. Preferably, the whole cap is transparent material. The transparent material portions are preferably made of plastic, such as polymethylmethacrylate (i.e. acrylic glass), butyrate (cellulose acetate butyrate), polycarbonate, ABS, high impact styrene, PETG (glycol modified polyethylene terephthalate), etc. Alternatively, the solid portions of the non-removable cap may be opaque, if one or more cut-outs (7*a*) are provided that offer an unobstructed view of the second applicator head (as shown in FIG. 8). The cap may fit over the sides of the closure, as shown in FIGS. 1, 5, 6 and 7, or the cap may rest on top of the closure, as shown in FIGS. 3, 8 and 9. The combination of cap (7) and closure (3) serves as a handle for manipulating the first applicator head (4).

In preferred applicator systems of the present invention, the second applicator head (6) is identical or substantially identical to the first applicator head (4). By "substantially identical", we mean that as viewed under the non-removable cap (7), a user can not tell the difference between the first and second applicator heads. For example, the second applicator head may differ from the first applicator head in some internal structure, dimension or material that is not visible to a user, while on the outside the two applicator heads are generally indistinguishable.

One benefit of the present invention is that in the closed (or fully assembled) configuration, as shown in FIGS. 5-9, a user is still able to see the type of applicator head that she will be purchasing without the need to package the functional applicator head separated from the reservoir. The state of the art of molding applicator heads has reduced the cost to where it is advantageously cheaper to provide the second (unusable) applicator head, rather than bulky plastic overshell packaging.

Another benefit is that throughout the life of the applicator system, the applicator head is visible so that a woman who owns several similar products will always be able to identify an applicator head according to the present invention.

FIGS. 3-10 demonstrate that various types of applicator heads may be used in an applicator system of the present invention. Obviously, the invention is not limited to the applicator heads shown.

What is claimed is:

1. A cosmetic applicator system (1) that comprises:

exactly one product reservoir (2) that is able to hold a product;

a closure (3) that is able to engage the reservoir (2) to seal and unseal the reservoir (2);

a first functional applicator head (4) and a second non-functional applicator head (6) that are substantially identical and coaxial with each other, and that extend from the closure (3) in opposite directions, a protective cap (7) that surrounds the second applicator head (6), wherein the protective cap is permanently affixed to the closure (3) to render the second applicator head non-functional; and wherein the second applicator head (6) is always visible through the cap (7).

2. A cosmetic applicator system (1) according to claim 1 wherein the whole protective cap (7) is transparent.

3. A cosmetic applicator system (1) that comprises:

exactly one product reservoir (2) that is able to hold a product;

a closure (3) that is able to engage the reservoir (2) to seal and unseal the reservoir (2);

a first functional applicator head (4) and a second non-functional applicator head (6) that are identical and coaxial with each other, and that extend from the closure (3) in opposite directions, a protective cap (7) that surrounds the second applicator head (6), wherein the protective cap is permanently affixed to the closure (3) to render the second applicator head non-functional; and wherein the second applicator head (6) is always visible through the cap (7).

4. A cosmetic applicator system (1) according to claim 3 wherein the whole protective cap (7) is transparent.

* * * * *